US007011236B2

(12) United States Patent
VanBrocklin

(10) Patent No.: US 7,011,236 B2
(45) Date of Patent: Mar. 14, 2006

(54) ASSEMBLY FOR SECURING AND SEALING A DISPENSER INCLUDING A DECORATIVE COLLAR TO A FLANGED CONTAINER

(75) Inventor: Owen F. VanBrocklin, Bristol, CT (US)

(73) Assignee: Rexam Beauty and Closure Inc., Thomaston, CT (US)

( * ) Notice: Subject to any disclaimer, the term of this patent is extended or adjusted under 35 U.S.C. 154(b) by 219 days.

(21) Appl. No.: 10/406,899

(22) Filed: Apr. 3, 2003

(65) Prior Publication Data

US 2004/0195269 A1 Oct. 7, 2004

(51) Int. Cl.
*B65D 88/054* (2006.01)

(52) U.S. Cl. ..... 222/321.9; 222/153.1; 215/274; 220/320

(58) Field of Classification Search ..... 222/1, 222/153.09, 320–321.9, 383.1, 385, 153.1; 215/274; 220/320
See application file for complete search history.

(56) References Cited

U.S. PATENT DOCUMENTS 3,129,854 A * 4/1964 Boehm et al. ..... 222/321.9
4,773,553 A * 9/1988 Van Brocklin ..... 215/272
4,984,702 A * 1/1991 Pierpont ..... 215/272
5,348,174 A * 9/1994 Velicka ..... 215/277
5,562,219 A 10/1996 Pous et al. ..... 215/275
5,709,324 A 1/1998 Peronnet ..... 222/321.9
5,799,810 A 9/1998 Pous et al. ..... 215/274
5,941,428 A * 8/1999 Behar et al. ..... 222/321.7
6,206,246 B1 * 3/2001 Bougamont et al. ..... 222/321.9
6,253,941 B1 * 7/2001 VanBrocklin et al. ..... 215/274
6,349,856 B1 * 2/2002 Chastel ..... 222/321.7
2002/0113093 A1 * 8/2002 De Laforcade ..... 222/321.9
2002/0185503 A1 * 12/2002 Beranger et al. ..... 222/321.9

* cited by examiner

*Primary Examiner*—Frederick Nicolas
*Assistant Examiner*—Melvin A. Cartagena
(74) *Attorney, Agent, or Firm*—St. Onge Steward Johnston & Reens LLC

(57) ABSTRACT

An assembly for securing and sealing a dispenser to a container having a flange surrounding an opening therein is provided. The assembly includes a dispenser sub-assembly having an outer body with an outer surface adapted to engage an inner surface of the opening so as to secure and seal the dispenser sub-assembly within the opening. A retaining collet having a downwardly extending skirt having a bottom portion extending radially outwardly is positioned to surround the flange. A decorative collar having a sleeve about its periphery is slideable through a path of movement over the retaining collet to an assembled position. The sleeve of the decorative collar deforms the bottom portion of the skirt of the retaining collet radially inwardly to a position under the flange of the container as the decorative collar is slid to the assembled position so as to maintain the decorative collar in the assembled position.

31 Claims, 6 Drawing Sheets

ASSEMBLY FOR SECURING AND SEALING A DISPENSER INCLUDING A DECORATIVE COLLAR TO A FLANGED CONTAINER

FIELD OF THE INVENTION

The present invention relates to an assembly for securing and sealing a dispenser, such as a pump, a valve, or other dispensing means to a flanged container. More particularly, the present invention relates to an improved assembly for securing a dispenser including a decorative collar to a container without the necessity of complex mechanical operations, and which includes an aesthetically pleasing decorative collar.

BACKGROUND OF THE INVENTION

It is often desirable to secure a dispenser, such as a pump, a valve, or other dispensing means to a container for storing a liquid product. A typical container may be made of glass and have a neck with an opening for dispensing the product. A flange having an inwardly directed ledge is often provided to facilitate attachment of a cap or dispensing device to the container.

Various methods are known for securing a dispenser onto a flanged container. One such method is to provide the dispenser with a metal mounting ferrule. To attach the dispenser to the container, the bottom of the skirt of the mounting ferrule is deformed, or crimped, beneath the container flange to retain the dispenser in place. Such a crimping operation, however, requires specialized machinery made specifically for the crimping operation. Moreover, since each dispenser must be positioned accurately, and then crimped, the process of crimping the mounting ferrules is relatively time consuming. Furthermore, set-up of the crimping process requires precise adjustment of the crimping head in order to fully crimp the mounting ferrule onto the container. If the flange of the container varies even slightly from the dimensions defined during set-up, the crimping process may easily fail. If the flange is too small, a tight crimp may not occur, which can result in leakage. If the flange is too large or if the height of the bottle varies from what is expected, the forces necessary for crimping may crush the flange, thereby causing the container to break. Such breaking of the container requires the assembly line to be stopped so the broken container can be removed and the assembly line machinery cleaned, and results in loss of the package, including the fragrance, which is often particularly costly.

Another method for securing a dispenser onto a flanged container, as disclosed in U.S. Pat. Nos. 5,562,219 and 5,799,810 to de Pous et al., utilizes a hard plastic collar having an annular recess which receives the flange. An annular retaining rib snap-locks under the flange when installed. Such designs, however, typically require the use of hard plastics, which are not effective for providing a liquid seal and therefore require a gasket. As such, leakage problems often result. Moreover, as is the case with crimping, variances in flange dimensions can easily cause failure. If the flange is too small, the retaining rib snap locks may not pull the collar into sealing engagement with the container, which can result in leakage. If the flange is too large, the retaining rib snap-locks may not fit properly underneath the flange, which too can result in leakage and retention failure of the dispenser.

The disadvantages of the above discussed methods and assemblies are substantially obviated by the assembly and method disclosed in U.S. Pat. No. 4,773,553 to Van Brocklin and U.S. Pat. No. 6,253,942 to Van Brocklin et al., which are incorporated herein by reference. The assembly disclosed therein comprises a mounting cup having a generally cylindrical skirt around its periphery and a sealing collar. The sealing collar includes a sleeve having a diameter sized to receive the sidewall of the flange, and sized to be encased by the mounting cup. The end portion of the sleeve, which comprises a plurality of spaced tabs, is in the path of movement of the mounting cup and is deformed radially inwardly beneath the flange ledge thereby to secure the collar to the flange.

However, it is not always desirable to use the flange as the means for securing and sealing the dispenser to the container. Rather, there are times when it is desirable to use the opening in the neck as the mechanism for sealing and securing the dispenser to the container.

Various methods are known for securing a dispenser onto a container using the inner diameter of the container's opening rather than a flange. One such method is to provide a portion of the dispenser assembly with a slightly larger outer diameter than a corresponding inner diameter of a portion of the container opening, such that when the dispenser assembly is pressed into the container opening, a frictional fit is created which both secures and seals the dispenser assembly therein much like a cork in a wine bottle. Such a method is disclosed in U.S. Pat. No. 6,010,039 to Bougamont. Another known method is to provide an outwardly extending radial protrusion around a portion of the dispenser assembly, which protrusion snaps into a corresponding radial channel provided in the inner diameter of the container opening. Such a method is disclosed in U.S. Pat. No. 5,709,324 to Peronnet et al.

While these methods disclosed in U.S. Pat. No. 6,010,039 to Bougamont and U.S. Pat. No. 5,709,324 to Peronnet et al. may provide adequate sealing and securing functions, and may even provide an aesthetically pleasing package when used with containers not having flanged necks, they suffer from the disadvantage of not providing an aesthetically pleasing package when used with some bottles which do have flanged necks.

What is desired, therefore, is an assembly which secures and seals a dispenser, such as a pump or valve, to a container, which attaches and seals to the inner diameter of the opening of the container, which is adapted to be used with containers having flanged necks, which is aesthetically pleasing even when used with containers having flanged necks, and which incorporates a decorative collar to hide the flanged neck of the container.

SUMMARY OF THE INVENTION

Accordingly, it is an object of the present invention to provide an assembly which secures and seals a dispenser, such as a pump or valve, to a container.

Another object of the present invention is to provide an assembly having the above characteristics and which attaches and seals to the inner diameter of the opening of the container.

A further object of the present invention is to provide an assembly having the above characteristics and which is adapted to be used with containers having flanged necks.

Still another object of the present invention is to provide an assembly having the above characteristics and which is aesthetically pleasing even when used with containers having flanged necks.

Yet a further object of the present invention is to provide an assembly having the above characteristics and which incorporates a decorative collar to hide the flanged neck of the container.

These and other objects of the present invention are achieved by provision of an assembly for securing and sealing a dispenser to a container having a flange surrounding an opening therein. The assembly includes a dispenser sub-assembly having an outer body with an outer surface adapted to engage an inner surface of the opening in the container when the dispenser sub-assembly is inserted in the opening in the container so as to secure and seal the dispenser sub-assembly within the opening in the container. A retaining collet having an outer surface having an outer diameter, and having a downwardly extending skirt having a bottom portion thereof extending radially outwardly is positioned to surround the flange in the container. The assembly also includes a decorative collar having a sleeve about its periphery, the sleeve having an inner surface having a diameter sized to encase the skirt of the retaining collet. The decorative collar is slideable through a path of movement over the retaining collet to an assembled position, and the sleeve of the decorative collar deforms the bottom portion of the skirt of the retaining collet radially inwardly to a position under the flange of the container as the decorative collar is slid to the assembled position, the sleeve of the decorative collar maintaining the decorative collar in the assembled position on the retaining collet.

In some embodiments, the outer surface of the outer body has a portion with a diameter greater than a portion of the inner surface of the opening in the container so as to secure and seal the dispenser sub-assembly within the opening in the container by frictional engagement between the outer surface of the outer body with the inner surface of the opening. In other embodiments, one of the outer surface of the outer body or the inner surface of the opening in the container has protruding therefrom an annular projection, the other of the outer surface of the outer body or the inner surface of the opening in the container has formed therein an annular channel, and the dispenser sub-assembly is secured and sealed within the opening in the container by snap-fit engagement of the annular projection and the annular channel. In certain of these embodiments, the annular projection projects outwardly from the outer surface of the outer body and the annular channel is formed in the inner surface of the opening in the container.

In some embodiments, the dispenser sub-assembly includes a flange extending outwardly from a top portion thereof in order to prevent the dispenser sub-assembly from being inserted into the opening in the container beyond a desired extent. In some embodiments, the outer body includes at least one tapered portion for facilitating insertion of the dispenser sub-assembly into the opening in the container. In some embodiments, the outer body and/or the retaining collet are formed from resilient deformable molded polymeric materials. In some embodiments, the decorative collar is formed from a substantially rigid material.

In some embodiments, a plurality of annular retaining rings are formed on the inner surface of the sleeve of the decorative collar. In these embodiments, the plurality of annular retaining rings are positioned to engage the outer surface of the retaining collet when the decorative collar is in the assembled position, and are dimensioned such that the plurality of annular retaining rings cause the outer surface of the retaining collet to deform around the plurality of annular retaining rings when the decorative collar is in the assembled position to enhance the maintenance of the decorative collar in the assembled position on the retaining collet.

In another respect, the present invention is directed to a method for securing and sealing a dispenser to a container having a flange surrounding an opening therein. A dispenser sub-assembly comprising an outer body having an outer surface adapted to engage an inner surface of the opening in the container when the dispenser sub-assembly is inserted in the opening in the container, is secured and sealed within the opening in the container. A retaining collet having an outer surface having an outer diameter, and having a downwardly extending skirt having a bottom portion thereof extending radially outwardly, is disposed on the flange of the container, and a decorative collar having a sleeve about its periphery, the sleeve having an inner surface having a diameter sized to encase the skirt of the retaining collet, is disposed in a pre-assembled position on the retaining collet. The decorative collar is slid through a path of movement over the retaining collet to an assembled position and the bottom portion of the skirt of the retaining collet is deformed radially inwardly to a position under the flange of the container as the decorative collar is slid to the assembled position, the sleeve of the decorative collar maintaining the decorative collar in the assembled position on the retaining collet.

In some embodiments, the outer surface of the outer body has a portion with a diameter greater than a portion of the inner surface of the opening in the container, and the securing and sealing step comprises the step of frictionally engaging the outer surface of the outer body within the inner surface of the opening so as to secure and seal the dispenser sub-assembly within the opening in the container. In other embodiments, one of the outer surface of the outer body or the inner surface of the opening in the container has protruding therefrom an annular projection, the other of the outer surface of the outer body or the inner surface of the opening in the container has formed therein an annular channel, and the securing and sealing step comprises the step of snap-fitting the annular projection within the annular channel so as to secure and seal the dispenser sub-assembly within the opening in the container.

Some embodiments further include the step of preventing the dispenser sub-assembly from being inserted into the opening in the container beyond a desired extent by providing the dispenser sub-assembly with a flange extending outwardly from a top portion thereof. Some embodiments further include the step of facilitating insertion of the dispenser sub-assembly into the opening in the container by providing the outer body with at least one tapered portion.

In some embodiments, a plurality of annular retaining rings are formed on the inner surface of the sleeve of the decorative collar, the plurality of annular retaining rings positioned to engage the outer surface of the retaining collet when the decorative collar is in the assembled position, and dimensioned such that the plurality of annular retaining rings cause the outer surface of the retaining collet to deform around the plurality of annular retaining rings when the decorative collar is in the assembled position to enhance the maintenance of the decorative collar in the assembled position on the retaining collet.

In some embodiments, the securing and sealing a dispenser sub-assembly step, the disposing a retaining collet step and the disposing a decorative collar step are performed simultaneously. In other embodiments, the securing and sealing a dispenser sub-assembly step, the disposing a retaining collet step and the disposing a decorative collar step are performed sequentially.

The invention and its particular features and advantages will become more apparent from the following detailed description considered with reference to the accompanying drawings.

DETAILED DESCRIPTION OF CERTAIN EMBODIMENTS OF THE INVENTION

Figure 1:
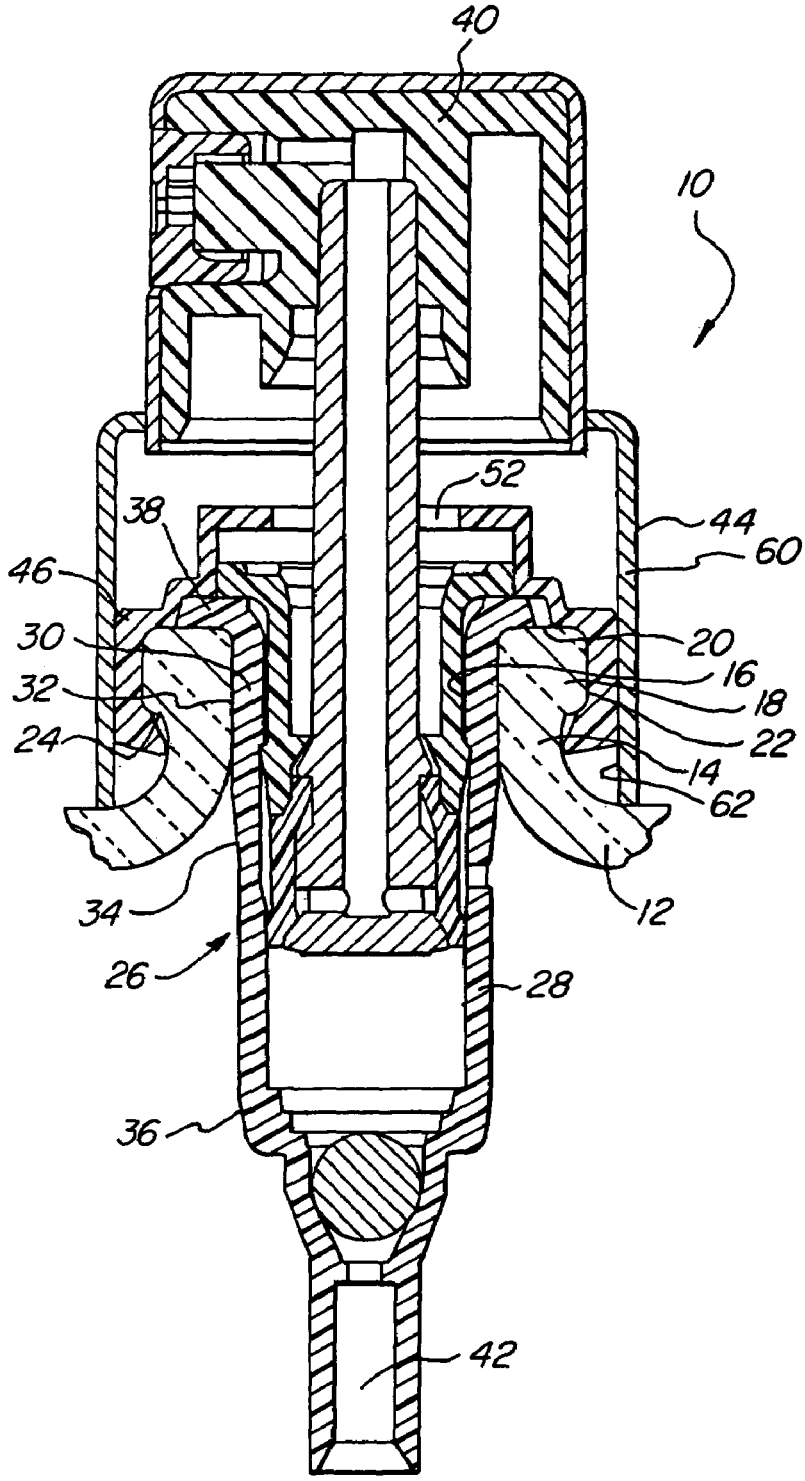
FIG. 1 is a partially cross-sectional view of an assembly for securing and sealing a dispenser to a flanged container in accordance with one embodiment of the present invention.

Referring first to FIG. 1, an assembly 10 in accordance with one embodiment of the present invention is shown. The assembly 10 is particularly suited for use with a container 12 of the type having a neck 14 with an opening 16 for dispensing product stored in the container 12. The neck 14 includes a flange 18 which includes an upper surface 20 surrounding the opening 16, a sidewall 22 about its periphery and an inwardly directed ledge 24 at the bottom of the flange 18. The container 12 is typically made of glass, although other types of materials such as plastic or metal can be utilized. Assembly 10 in accordance with the present invention is particularly suited for use with cosmetic containers such as those containing perfume.

The assembly 10 of the present invention includes a spray pump sub-assembly 26 secured and sealed in place within opening 16 of container 12. The spray pump sub-assembly 26 includes an outer pump body 28 which, unlike the pump bodies of spray pump sub-assemblies of conventional assemblies used with containers having flanged openings, is particularly adapted to secure and seal assembly 10 within opening 16 of container 12. In the embodiment shown in FIG. 1, this securing and sealing within opening 16 of container 12 is achieved by creating a portion 30 of outer pump body 28 with an outer diameter which is slightly greater than an inner diameter of a corresponding portion 32 of opening 16 of container 12. Because outer pump body is created from a deformable material, and preferably a resilient deformable material such as polyethylene, including linear low density polyethylene, rubber elastomers or vinyl, when pump sub-assembly 26 is forced into opening 16 of container 12, outer pump body 28 deforms slightly to create a frictional engagement between the outer surface of portion 30 of outer pump body 28 and the inner surface of corresponding portion 32 of opening 16 of container 12, thereby creating a seal therebetween and securing pump sub-assembly 26 within opening 16 of container 12.

Outer pump body 28 may be provided with one or more tapered portions 34, 36 in order to facilitate insertion of outer pump body 28 into opening 16 of container 12. Outer pump body 28 may also be provided with an outwardly projecting flange 38 at the top end thereof which abuts top surface 20 of container 12 in order to prevent outer pump body 28 from being inserted too far into opening 16 of container 12 and possibly to aid in sealing.

In most other respects, pump sub-assembly 26 is generally configured as is typical of those known in the art. The mode of operation of the assembly is similar to that shown in U.S. Pat. No. 5,192,006 to Van Brocklin et al., which is hereby incorporated by reference, and will not be explained in detail, since such will be immediately obvious to one skilled in the art. The pump is actuated by manual depression of an actuator 40, and liquid to be dispensed is drawn in through an opening 42 is a lower end of pump sub-assembly 26.

As may be seen by examining FIG. 1, if pump sub-assembly 26 and container 12 were not provided with some type of decorative element, the package created thereby may not be aesthetically pleasing, as various portions of pump sub-assembly 26 would be visible. As such, assembly 10 includes a decorative collar 44 which is held in position by retaining collet 46.

Retaining collet 46 comprises a deformable material, and preferably a resilient deformable material such as polyethylene, including linear low density polyethylene, rubber elastomers or vinyl. Retaining collet 46 includes an upper wall 48 which may have various steps, channels, flanges or the like to accommodate the various elements of pump subassembly 26 and bottle neck 14. Retaining collet 46 also includes a skirt 50 extending downwardly from upper wall 48. Skirt 50 has an inner diameter sized to receive the sidewall 22 of the flange 18, and preferably, the inner diameter of skirt 50 is slightly larger than the diameter of the flange sidewall 22 to provide free-fitting application of retaining collet 46 onto the flange 18 to facilitate assembly. Skirt 50 is preferably generally cylindrical and symmetric with respect to an axis thereof. Retaining collet 46 includes a central opening 52 for receiving portions of pump sub-assembly 26.

Figure 2:
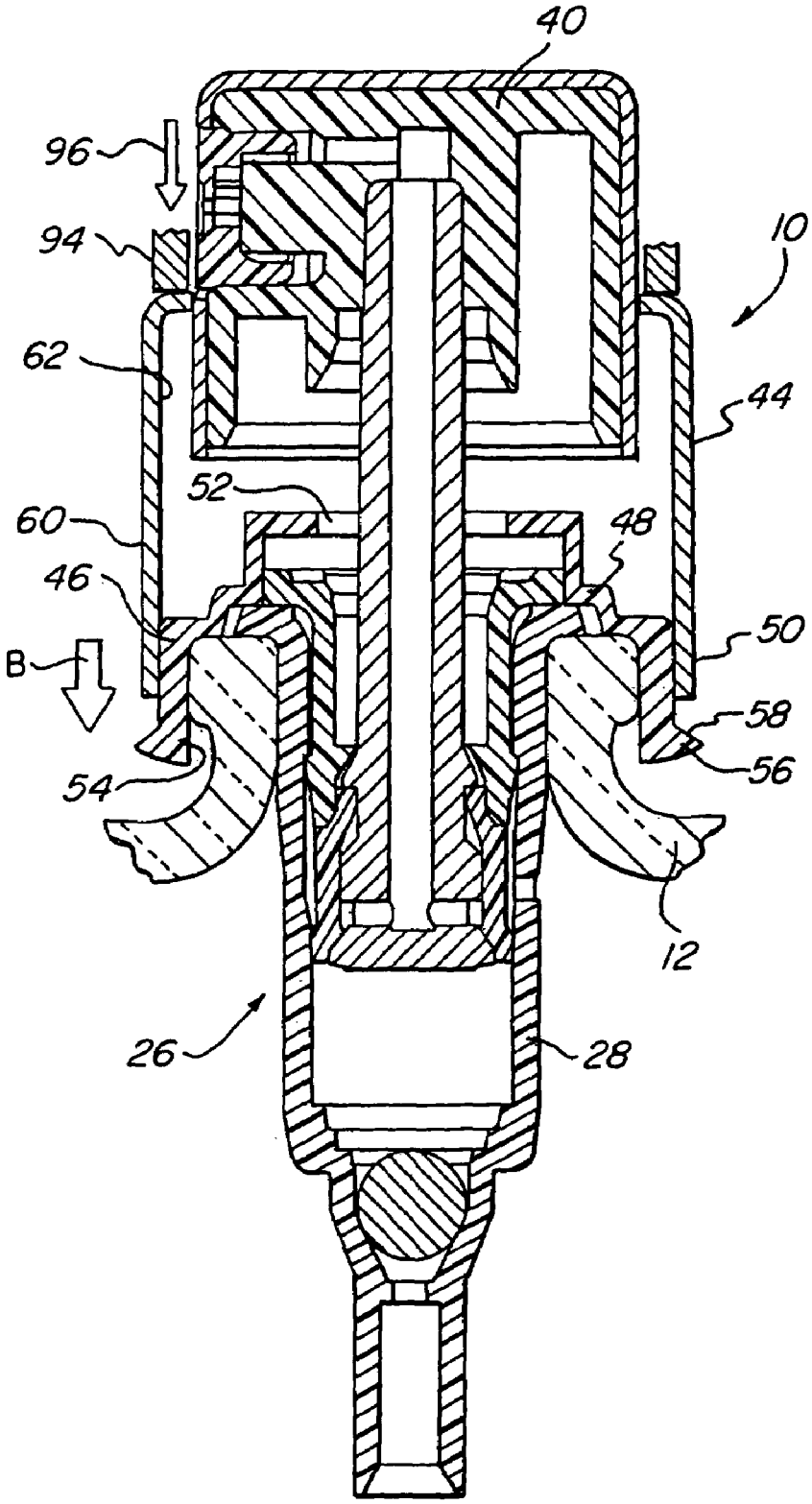
FIG. 2 is a partially cross-sectional view of the assembly for securing and sealing a dispenser to a flanged container of FIG. 1 showing the assembly installed on the bottle, but before the decorative collar has been moved to the assembled position.

Referring in particular to FIG. 2, the bottom portion 54 of skirt 50 includes a radially outwardly protruding member 56 located in the path of movement of the decorative collar 44. More specifically, the skirt 50 includes an inclined camming surface 58. When the decorative collar 44 moves downwardly (indicated by arrow B in FIG. 2) to the assembled position (shown in FIG. 1) it contacts camming surface 58 and forces the protruding member 56 radially inwardly. This causes a frictional engagement between retaining collet 46 and decorative collar 44 in order to secure decorative collar in place on assembly 10.

It should be understood that unlike the devices disclosed in U.S. Pat. Nos. 4,773,553, 6,253,942, 5,562,219 and 5,799,810, retaining collet 46 is not necessary to provide sealing or securing functions other than to retain decorative collar 44 in place. Similarly, decorative collar 44 is just that—purely decorative. Pump sub-assembly 26 is secured and sealed to container 12 substantially solely by its cooperation with container opening 16.

Skirt 50 may be continuous or may include a plurality of slots, cuts, indentations or slits defining a plurality or discrete tabs, fingers, legs, claws, or the like, with or without webs. It has been found that one benefit of providing a continuous skirt 50 is that the thickness of the skirt 50 can be reduced, thereby decreasing the amount of material required for manufacturing the retaining collet 46 and thus the overall cost of the system 10 in general. A decreased thickness of skirt 50 also allows for the use of standard collars typically used with crimped assemblies. Thus, custom made decorative collars are not required, which also reduces manufacturing costs.

Decorative collar 44 is formed from a material which is substantially rigid, such as metal, hard plastic, wood or glass, and includes a sleeve 60 which has a shape symmetric with respect to the axis thereof. More specifically, decorative collar 44 has a generally cylindrical shape, but may also have a frustoconical shape symmetric with respect to its longitudinal axis. The inner diameter of sleeve 60 is approximately equal to the outer diameter of skirt 50. If desired, the inner diameter of sleeve 60 may be slightly less than the outer diameter of skirt 50 so that skirt 50 is slightly compressed between the flange sidewall 22 and the inner surface 62 of the decorative collar 44.

Figure 3:
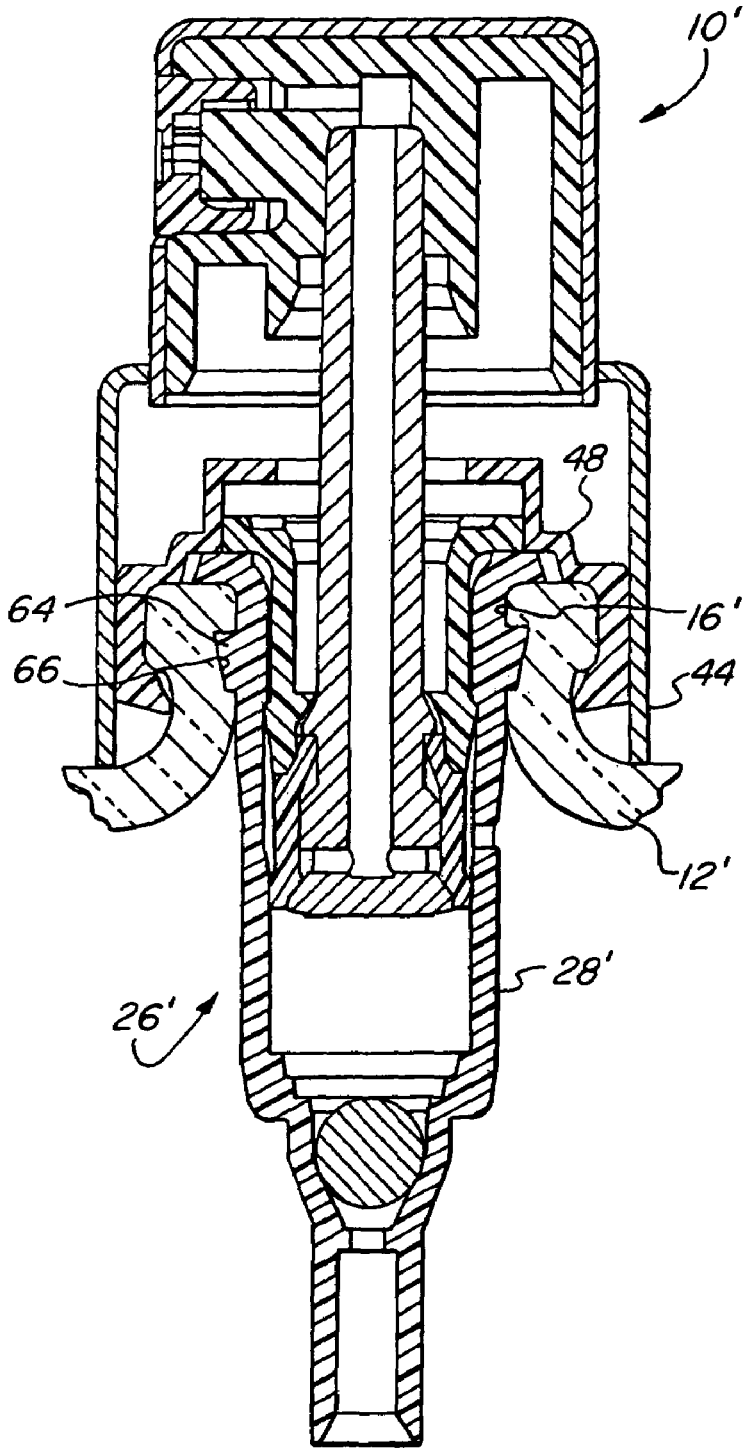
FIG. 3 is a partially cross-sectional view of an assembly for securing and sealing a dispenser to a flanged container in accordance with another embodiment of the present invention.
Figure 4:
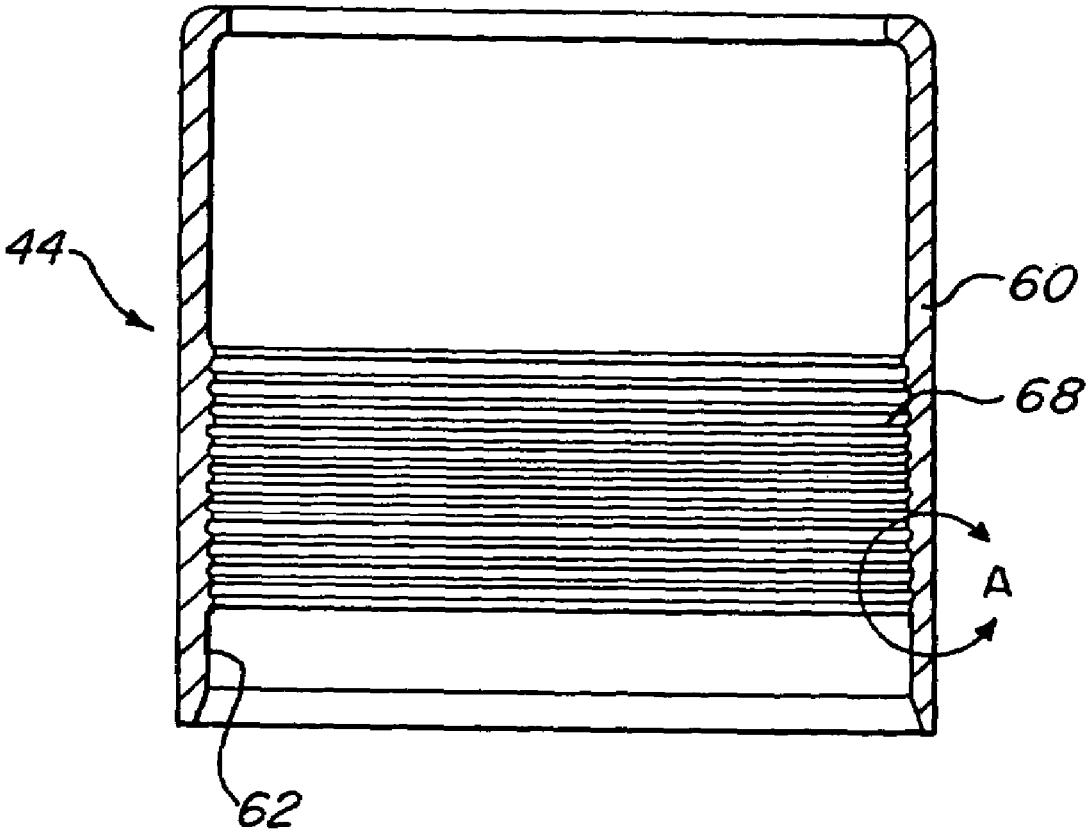
FIG. 4 is a partially cross-sectional view of an embodiment of a decorative collar of the assembly for securing and sealing a dispenser to a flanged container of FIG. 1 or FIG. 3.

Referring now to FIG. 3, a second embodiment of assembly 10' is shown. Assembly 10' is configured substantially the same as assembly 10 with the exception that rather then outer pump body 28 being secured and sealed within opening 16 in container 12 strictly by frictional engagement therebetween, outer pump body 28' includes an annular projection 64 extending outwardly therefrom, which annular projection 64 is snap-fit into a cooperating annular channel 66 provided in opening 16' of container 12'. Engagement of annular projection 64 with cooperating annular channel 66 may aid with the securing and sealing of pump sub-assembly 26' within opening 16'. Annular projection 64 and cooperating annular channel 66 may have any of a number of configurations, with a generally frustoconical configuration as shown in FIG. 3 being one preferred example. It should also be noted that annular projection 64 and cooperating annular channel 66 may be reversed such that annular projection 64 is formed within opening 16' with cooperating annular channel 66 formed in outer pump body 28'.

Figure 5:
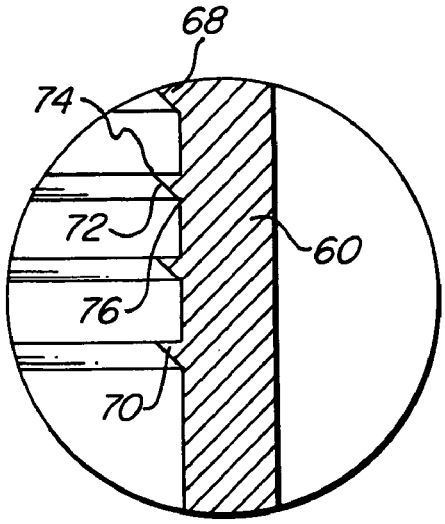
FIG. 5 is an enlarged partially cross-sectional view of portion A of the decorative collar of FIG. 4 showing a decorative collar having a plurality of frustoconical splines in accordance with one embodiment of the invention.
Figure 6:
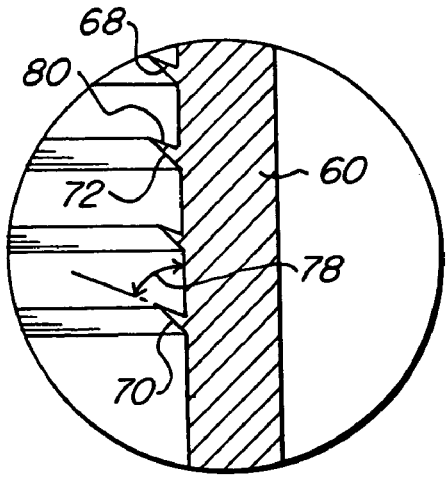
FIG. 6 is an enlarged partially cross-sectional view of portion A of the decorative collar of FIG. 4 showing a decorative collar having a plurality of barbed splines in accordance with another embodiment of the invention.
Figure 7:
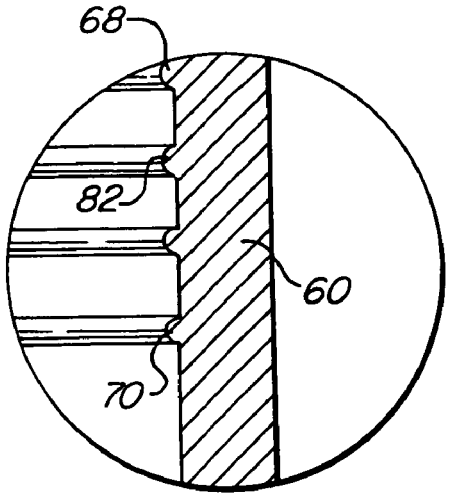
FIG. 7 is an enlarged partially cross-sectional view of portion A of the decorative collar of FIG. 4 showing a decorative collar having a plurality of partially rounded splines in accordance with another embodiment of the invention.

Referring now to FIGS. 4–10, inner surface 62 of sleeve 60 of decorative collar 44 may include a plurality of retaining rings 68 to inhibit the removal of decorative collar 44 from retaining collet 46 once assembled. Referring specifically now to FIGS. 5–7, retaining rings 68 may comprise a plurality of annular splines 70 protruding inwardly from inner surface 62 of sleeve 60. Splines 70 are located such that they are coincident with and engage an outer surface of skirt 50 when decorative collar 44 is in the assembled position. Splines 70 protrude to such an extent that splines 70 cause the outer surface of skirt 50 to deform around splines 70 when decorative collar 44 is in the assembled position to enhance the maintenance of decorative collar 44 in the assembled position on the retaining collet 46. Preferably, splines 70 are formed by rolling them on the inner surface 62 of the sleeve 60. By using this process to create splines 70, splines 70 can be formed without causing any aesthetically displeasing deformations on the smooth outer surface of decorative collar 44, and standard collars typically used with crimped assemblies can be modified rather than requiring the manufacture of more expensive custom made decorative collars.

In the embodiment shown in FIG. 5, each of splines 70 has a frustoconical portion 72 having an upper end 74 with a diameter less than the diameter of the inner surface 62 of sleeve 60 and having a lower end 76 with a diameter greater than that of the upper end 74. Preferably, the lower end 76 of the frustoconical portion 72 of each of splines 70 has a diameter substantially equal to the diameter of the inner surface 62 of sleeve 60. FIG. 6 shows a sleeve 60 having splines 70 similar to those shown in FIG. 5, wherein each of splines 70 has a frustoconical portion 72. However, in this embodiment, each of splines 70 also includes a backdrafted angle 78 in the upper surface 80 of each spline 70 to form a barb. FIG. 7 shows another embodiment of decorative collar 44 wherein sleeve 60 includes a plurality of splines 70 having a partially rounded portion 82. It should be understood that while splines 70 may provide some advantages, the inner surface 62 of sleeve 60 may be smooth. It should also be understood that although the embodiment shown in FIG. 7 may be used, the embodiments shown in FIGS. 5 and 6 are preferred. The frustoconical configuration of these embodiments allow for assembly with a lesser force, but once assembled, require a greater force for disassembly because the upper ends 74 of splines 70 dig into the outer surface of skirt 50.

Figure 8:
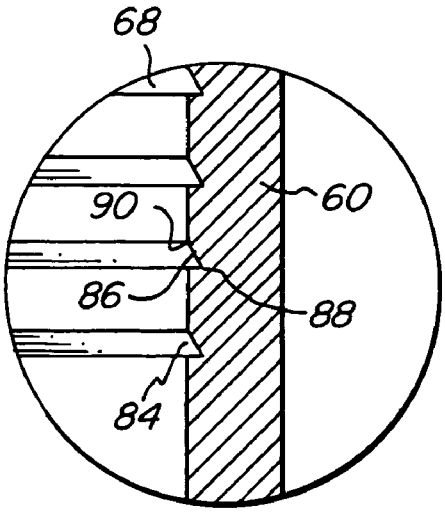
FIG. 8 is an enlarged partially cross-sectional view of portion A of the decorative collar of FIG. 4 showing a decorative collar having a plurality of frustoconical grooves in accordance with another embodiment of the invention.
Figure 9:
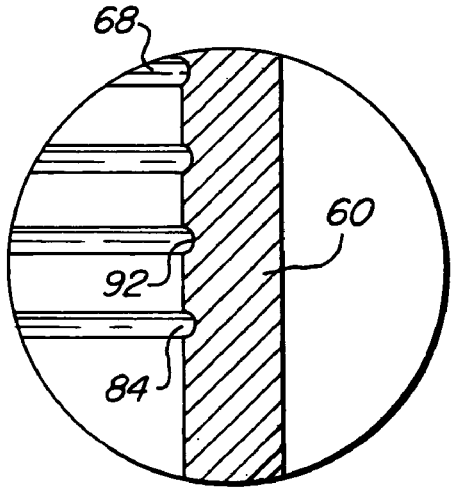
FIG. 9 is an enlarged partially cross-sectional view of portion A of the decorative collar of FIG. 4 showing a decorative collar having a plurality of partially rounded grooves in accordance with another embodiment of the invention.

Referring specifically now to FIGS. 8 and 9, retaining rings 68 may comprise a plurality of annular grooves 84 recessed into inner surface 62 of sleeve 60. Grooves 84 are located such that they are coincident with and engage an outer surface of skirt 50 when decorative collar 44 is in the assembled position. Grooves 84 are formed to such an extent that grooves 84 cause the outer surface of skirt 50 to deform to substantially fill grooves 84 when decorative collar 44 is in the assembled position to enhance the maintenance of decorative collar 44 in the assembled position on retaining collet 46. Preferably, grooves 84 are formed by rolling them on the inner surface 62 of sleeve 60. By using this process to create grooves 84, grooves 84 can be formed without causing any aesthetically displeasing deformations on the smooth outer surface of decorative collar 44, and standard collars typically used with crimped assemblies can be modified rather than requiring the manufacture of more expensive custom made decorative collars.

In the embodiment shown in FIG. 8, each of grooves 84 has a frustoconical portion 86 having a lower end 88 with a diameter larger than the diameter of the inner surface 62 of the sleeve 60 and having an upper end 90 with a diameter less than that of the lower end 88. Preferably, the upper end 90 of the frustoconical portion 86 of each of grooves 84 has a diameter substantially equal to the diameter of the inner surface 62 of sleeve 60. FIG. 9 shows another embodiment of decorative collar 44 wherein sleeve 60 includes a plurality of grooves 84 having a partially rounded portion 92. It should be understood that while grooves 84 may provide some advantages, the inner surface 62 of sleeve 60 may be smooth. It should also be understood that although the embodiment shown in FIG. 9 may be used, the embodiment shown in FIG. 8 is preferred. The frustoconical configuration of this embodiment allows for assembly with a lesser force, but once assembled, require a greater force for disassembly because the upper ends 90 of grooves 84 dig into the outer surface of skirt 50.

Figure 10:
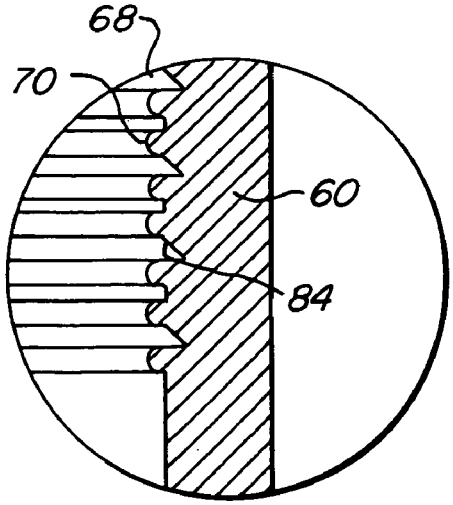
FIG. 10 is an enlarged partially cross-sectional view of portion A of the decorative collar of FIG. 4 showing a decorative collar having a combination of a plurality of frustoconical grooves and a plurality of partially rounded splines in accordance with another embodiment of the invention.

Referring specifically now to FIG. 10, retaining rings 68 may comprise a combination of a plurality of annular splines 70 protruding from inner surface 62 of sleeve 60 and a plurality of annular grooves 84 recessed into inner surface 62 of sleeve 60. Preferably, grooves 84 and splines 70 are formed in one action by rolling them on the inner surface 62 of the sleeve 60. More specifically, as grooves 84 are rolled, material is displaced to at the same time create splines 70. FIG. 10 shows frustoconical grooves 84 and partially rounded splines 70. However, it should be understood that various combinations of groove and spline configurations may be used.

Referring now again to FIGS. 1 through 3, a method for assembling assembly 10 is explained. Pump sub-assembly 26 is inserted into opening 16 in container 12 and pushed downward such that pump sub-assembly 26 is secured and sealed within opening 16 either by frictional engagement (FIGS. 1 and 2) or by a snap-fit arrangement (FIG. 3) as described fully above. Retaining collet 46 and decorative collar 44 may be carried on pump sub-assembly 26 in the pre-assembled condition (FIG. 2) for ease of assembly and inventory or may be disposed thereon after pump sub-assembly 26 is secured and sealed within opening 16. In either event, it should be understood that while retaining collet 46 and decorative collar 48 are in the pre-assembled condition, pump sub-assembly 26 is already fully secured and sealed within opening 16 in container 12.

An annular ring or cup 94 is then moved downwardly in the direction of arrow 96 until decorative collar 44 reaches the position shown in FIG. 1, which is the assembled position. The annular ring or cup 94 is shown schematically and is connected to suitable mechanical devices for moving the ring or cup 94 downwardly. The container 12 is maintained in a stationary position, and the components slide only axially along a longitudinal axis which is common to the decorative collar 44, the retaining collet 46 and the container opening 16. The sleeve 60 of the decorative collar 44 contacts the radially protruding member 56 of the bottom portion 54 of the skirt 50, or more precisely, camming surface 58, and exerts a downward force thereon.

As the decorative collar 44 is forced further downwardly by the ring or cup 94, the sleeve 60 urges the protruding member 56 and the camming surface 58 thereof radially inwardly and thus deforms the bottom portion 54 to a position under the ledge 24 of the flange 18, as shown in FIG. 1. It should be understood that by a "ledge" it is meant an inward slot or groove which is capable of receiving bottom portion 54. In certain instances, it may be desirable to include a flange 18 having a continuous sidewall which extends to the shoulder of the container 12. In such instance, the ledge 24 would be simply an annular groove sized to receive the deformed bottom portion 54. The decorative collar 44 is now retained by the retaining collet 46 in an aesthetically pleasing position.

The method of assembly has been described with the annular ring or cup 94 moving with respect to a stationary container 12. It should be understood that it is the relative movement which produces the assembly of the various components, and it is also possible to move the container 12 and the various components upwardly with respect to an annular ring or cup 94.

As can be appreciated, the method of assembly is particularly simple and does not require complicated machinery. There are only two required steps: (1) pressing the pump sub-assembly 26 into the opening 16 in container 12, and (2) reciprocating the annular ring or cup 94 which contacts the decorative collar 44. Moreover, these steps could easily be combined into one single mechanical process. If necessary, the components could be assembled by a hand press.

The present invention, therefore, provides an assembly which secures and seals a dispenser, such as a pump or valve, to a container, which attaches and seals to the inner diameter of the opening of the container, which is adapted to be used with containers having flanged necks, which is aesthetically pleasing even when used with containers having flanged necks, and which incorporates a decorative collar to hide the flanged neck of the container.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An assembly for securing and sealing a dispenser to a container having a flange surrounding an opening therein, said assembly comprising:

a dispenser sub-assembly comprising an outer body having an outer surface adapted to engage an inner surface of the opening in the container when said dispenser sub-assembly is inserted in the opening in the container so as to secure and seal said dispenser sub-assembly within the opening in the container, wherein the outer surface of the outer body has a portion with a diameter greater than a portion of the inner surface of the opening in the container so as to secure and seal said dispenser sub-assembly within the opening in the container by frictional engagement between the outer surface of the outer body with the inner surface of the opening;

a retaining collet positioned to surround the flange in the container, said retaining collet having an outer surface having an outer diameter, and having a downwardly extending skirt having a bottom portion thereof extending radially outwardly;

a decorative collar having a sleeve about its periphery, the sleeve having an inner surface having a diameter sized to encase the skirt of said retaining collet, said decorative collar slideable through a path of movement over said retaining collet to an assembled position, the sleeve of said decorative collar deforming the bottom portion of the skirt of said retaining collet radially inwardly to a position under the flange of the container as said decorative collar is slid to the assembled position, the sleeve of said decorative collar maintaining said decorative collar in the assembled position on said retaining collet; and wherein said retaining collet provides substantially no sealing and securing functions other than to retain said decorative collar in place such that said assembly is secured and sealed to the container substantially solely by its cooperation with the opening in the container.

2. The assembly of claim 1 wherein said dispenser sub-assembly includes a flange extending outwardly from a top portion thereof in order to prevent said dispenser sub-assembly from being inserted into the opening in the container beyond a desired extent.

3. The assembly of claim 1 wherein the outer body includes at least one tapered portion for facilitating insertion of said dispenser sub-assembly into the opening in the container.

4. The assembly of claim 1 wherein the outer body is formed from a resilient deformable molded polymeric material.

5. The assembly of claim 1 wherein said retaining collet is formed from a resilient deformable molded polymeric material.

6. The assembly of claim 1 wherein said decorative collar is formed from a substantially rigid material.

7. The assembly of claim 1 further comprising a plurality of annular retaining rings formed on the inner surface of the sleeve of said decorative collar, the plurality of annular retaining rings positioned to engage the outer surface of said retaining collet when said decorative collar is in the assembled position, and dimensioned such that the plurality of annular retaining rings cause the outer surface of said retaining collet to deform around the plurality of annular retaining rings when said decorative collar is in the assembled position to enhance the maintenance of said decorative collar in the assembled position on said retaining collet.

8. An assembly for securing and sealing a dispenser to a container having a flange surrounding an opening therein, said assembly comprising:

a dispenser sub-assembly formed from a resilient deformable molded polymeric material and comprising an outer body having an outer surface with a portion having a diameter greater than a portion of the inner surface of the opening in the container so as to secure and seal said dispenser sub-assembly within the opening in the container by frictional engagement between the outer surface of the outer body with the inner surface of the opening;

a retaining collet formed from a resilient deformable molded polymeric material and positioned to surround the flange in the container, said retaining collet and having an outer surface having an outer diameter, and having a downwardly extending skirt having a bottom portion thereof extending radially outwardly;

a decorative collar formed from a substantially rigid material and having a sleeve about its periphery, the sleeve having an inner surface having a diameter sized to encase the skirt of said retaining collet, said decorative collar slideable through a path of movement over said retaining collet to an assembled position, the sleeve of said decorative collar deforming the bottom portion of the skirt of said retaining collet radially inwardly to a position under the flange of the container as said decorative collar is slid to the assembled position, the sleeve of said decorative collar maintaining said decorative collar in the assembled position on said retaining collet; and wherein said retaining collet provides substantially no sealing and securing functions other than to retain said decorative collar in place such that said assembly is secured and sealed to the container substantially solely by its cooperation with the opening in the container.

9. The assembly of claim 8 wherein said dispenser sub-assembly includes a flange extending outwardly from a top portion thereof in order to prevent said dispenser sub-assembly from being inserted into the opening in the container beyond a desired extent.

10. The assembly of claim 8 wherein the outer body includes at least one tapered portion for facilitating insertion of said dispenser sub-assembly into the opening in the container.

11. The assembly of claim 8 further comprising a plurality of annular retaining rings formed on the inner surface of the sleeve of said decorative collar, the plurality of annular retaining rings positioned to engage the outer surface of said retaining collet when said decorative collar is in the assembled position, and dimensioned such that the plurality of annular retaining rings cause the outer surface of said retaining collet to deform around the plurality of annular retaining rings when said decorative collar is in the assembled position to enhance the maintenance of said decorative collar in the assembled position on said retaining collet.

12. A method for securing and sealing a dispenser to a container having a flange surrounding an opening therein, said method comprising the steps of:

securing and sealing a dispenser sub-assembly comprising an outer body having an outer surface adapted to engage an inner surface of the opening in the container when the dispenser sub-assembly is inserted in the opening in the container, within the opening in the container, wherein the outer surface of the outer body has a portion with a diameter greater than a portion of the inner surface of the opening in the container, and wherein said securing and sealing step comprises the step of frictionally engaging the outer surface of the outer body within the inner surface of the opening so as to secure and seal the dispenser sub-assembly within the opening in the container;

disposing a retaining collet having an outer surface having an outer diameter, and having a downwardly extending skirt having a bottom portion thereof extending radially outwardly, on the flange of the container;

disposing a decorative collar having a sleeve about its periphery, the sleeve having an inner surface having a diameter sized to encase the skirt of the retaining collet, in a pre-assembled position on the retaining collet;

sliding the decorative collar through a path of movement over the retaining collet to an assembled position and deforming the bottom portion of the skirt of the retaining collet radially inwardly to a position under the flange of the container as the decorative collar is slid to the assembled position, the sleeve of the decorative collar maintaining the decorative collar in the assembled position on the retaining collet; and wherein said retaining collet provides substantially no sealing and securing functions other than to retain said decorative collar in place such that said assembly is secured and sealed to the container substantially solely by its cooperation with the opening in the container.

13. The method of claim 12 further comprising the step of preventing the dispenser sub-assembly from being inserted into the opening in the container beyond a desired extent by providing the dispenser sub-assembly with a flange extending outwardly from a top portion thereof.

14. The method of claim 12 further comprising the step of facilitating insertion of the dispenser sub-assembly into the opening in the container by providing the outer body with at least one tapered portion.

15. The method of claim 12 further comprising the step of forming a plurality of annular retaining rings on the inner surface of the sleeve of the decorative collar, the plurality of annular retaining rings positioned to engage the outer surface of the retaining collet when the decorative collar is in the assembled position, and dimensioned such that the plurality of annular retaining rings cause the outer surface of the retaining collet to deform around the plurality of annular retaining rings when the decorative collar is in the assembled position to enhance the maintenance of the decorative collar in the assembled position on the retaining collet.

16. The method of claim 12 wherein said securing and sealing a dispenser sub-assembly step, said disposing a retaining collet step and said disposing a decorative collar step are performed simultaneously.

17. The method of claim 12 wherein said securing and sealing a dispenser sub-assembly step, said disposing a retaining collet step and said disposing a decorative collar step are performed sequentially.

18. An assembly for securing and sealing a dispenser to a container having a flange surrounding an opening therein, said assembly comprising:

a dispenser sub-assembly comprising an outer body having an outer surface adapted to engage an inner surface of the opening in the container when said dispenser sub-assembly is inserted in the opening in the container so as to secure and seal said dispenser sub-assembly within the opening in the container, wherein one of the outer surface of the outer body or the inner surface of the opening in the container has protruding therefrom an annular projection, wherein the other of the outer surface of the outer body or the inner surface of the opening in the container has formed therein an annular channel, and wherein said dispenser sub-assembly is secured and sealed within the opening in the container by snap-fit engagement of the annular projection and the annular channel;

a retaining collet positioned to surround the flange in the container, said retaining collet having an outer surface having an outer diameter, and having a downwardly extending skirt having a bottom portion thereof extending radially outwardly; and a decorative collar having a sleeve about its periphery, the sleeve having an inner surface having a diameter sized to encase the skirt of said retaining collet, said decorative collar slideable through a path of movement over said retaining collet to an assembled position, the sleeve of said decorative collar deforming the bottom portion of the skirt of said retaining collet radially inwardly to a position under the flange of the container as said decorative collar is slid to the assembled position, the sleeve of said decorative collar maintaining said decorative collar in the assembled position on said retaining collect; and wherein said retaining collet provides substantially no sealing and securing functions other than to retain said decorative collar in place such that said assembly is secured and sealed to the container substantially solely by its cooperation with the opening in the container.

19. The assembly of claim 18 wherein the annular projection projects outwardly from the outer surface of the outer body and wherein the annular channel is formed in the inner surface of the opening in the container.

20. The assembly of claim 18 wherein said dispenser sub-assembly includes a flange extending outwardly from a top portion thereof in order to prevent said dispenser sub-assembly from being inserted into the opening in the container beyond a desired extent.

21. The assembly of claim 18 wherein the outer body includes at least one tapered portion for facilitating insertion of said dispenser sub-assembly into the opening in the container.

22. The assembly of claim 18 wherein the outer body is formed from a resilient deformable molded polymeric material.

23. The assembly of claim 18 wherein said retaining collet is formed from a resilient deformable molded polymeric material.

24. The assembly of claim 18 wherein said decorative collar is formed from a substantially rigid material.

25. The assembly of claim 18 further comprising a plurality of annular retaining rings formed on the inner surface of the sleeve of said decorative collar, the plurality of annular retaining rings positioned to engage the outer surface of said retaining collet when said decorative collar is in the assembled position, and dimensioned such that the plurality of annular retaining rings cause the outer surface of said retaining collet to deform around the plurality of annular retaining rings when said decorative collar is in the assembled position to enhance the maintenance of said decorative collar in the assembled position on said retaining collet.

26. A method for securing and sealing a dispenser to a container having a flange surrounding an opening therein, said method comprising the steps of:

securing and sealing a dispenser sub-assembly comprising an outer body having an outer surface adapted to engage an inner surface of the opening in the container when the dispenser sub-assembly is inserted in the opening in the container, within the opening in the container, wherein one of the outer surface of the outer body or the inner surface of the opening in the container has protruding therefrom an annular projection, wherein the other of the outer surface of the outer body or the inner surface of the opening in the container has formed therein an annular channel, and wherein said securing and sealing step comprises the step of snap-fitting the annular projection within the annular channel so as to secure and seal the dispenser sub-assembly within the opening in the container;

disposing a retaining collet having an outer surface having an outer diameter, and having a downwardly extending skirt having a bottom portion thereof extending radially outwardly, on the flange of the container;

disposing a decorative collar having a sleeve about its periphery, the sleeve having an inner surface having a diameter sized to encase the skirt of the retaining collet, in a pre-assembled position on the retaining collet;

sliding the decorative collar through a path of movement over the retaining collet to an assembled position and deforming the bottom portion of the skirt of the retaining collet radially inwardly to a position under the flange of the container as the decorative collar is slid to the assembled position, the sleeve of the decorative collar maintaining the decorative collar in the assembled position on the retaining collet; and wherein said retaining collet provides substantially no sealing and securing functions other than to retain said decorative collar in place such that said assembly is secured and sealed to the container substantially solely by its cooperation with the opening in the container.

27. The method of claim 26 further comprising the step of preventing the dispenser sub-assembly from being inserted into the opening in the container beyond a desired extent by providing the dispenser sub-assembly with a flange extending outwardly from a top portion thereof.

28. The method of claim 26 further comprising the step of facilitating insertion of the dispenser sub-assembly into the opening in the container by providing the outer body with at least one tapered portion.

29. The method of claim 26 further comprising the step of forming a plurality of annular retaining rings on the inner surface of the sleeve of the decorative collar, the plurality of annular retaining rings positioned to engage the outer surface of the retaining collet when the decorative collar is in the assembled position, and dimensioned such that the plurality of annular retaining rings cause the outer surface of the retaining collet to deform around the plurality of annular retaining rings when the decorative collar is in the assembled position to enhance the maintenance of the decorative collar in the assembled position on the retaining collet.

30. The method of claim 26 wherein said securing and sealing a dispenser sub-assembly step, said disposing a retaining collet step and said disposing a decorative collar step are performed simultaneously.

31. The method of claim 26 wherein said securing and sealing a dispenser sub-assembly step, said disposing a retaining collet step and said disposing a decorative collar step are performed sequentially.

* * * * *

UNITED STATES PATENT AND TRADEMARK OFFICE

CERTIFICATE OF CORRECTION

PATENT NO. : 7,011,236 B2
DATED : March 14, 2006
INVENTOR(S) : Owen F. VanBrocklin It is certified that error appears in the above-identified patent and that said Letters Patent is hereby corrected as shown below:

Title page,
Item [73], should read:
-- [73] Assignee: Rexam Beauty and Closures Inc.,
Thomaston, CT (US) --.

Signed and Sealed this

Thirteenth Day of June, 2006

JON W. DUDAS
*Director of the United States Patent and Trademark Office*